US006394275B1

(12) United States Patent
Paliotta et al.

(10) Patent No.: US 6,394,275 B1
(45) Date of Patent: May 28, 2002

(54) CHILD RESISTANT PACKAGE

(75) Inventors: Michael Paliotta, Horseheads; George L. Howell, Elmira, both of NY (US)

(73) Assignee: F. M. Howell & Company, Elmira, NY (US)

( * ) Notice: Subject to any disclaimer, the term of this patent is extended or adjusted under 35 U.S.C. 154(b) by 38 days.

(21) Appl. No.: 09/685,596

(22) Filed: Oct. 11, 2000

(51) Int. Cl.[7] ..... B65D 83/04
(52) U.S. Cl. ..... 206/531; 206/468
(58) Field of Search ..... 206/528, 531, 206/532, 534.1, 468

(56) References Cited

U.S. PATENT DOCUMENTS

| | | | | |
|---|---|---|---|---|
| 2,324,228 A | | 7/1943 | Nash | |
| 2,411,471 A | | 11/1946 | Sherman | |
| 2,497,455 A | | 2/1950 | Johnson | |
| 2,780,353 A | | 2/1957 | Volckening | |
| 2,971,638 A | | 2/1961 | Allison et al. | |
| 3,610,410 A | | 10/1971 | Seeley | |
| 3,820,665 A | * | 6/1974 | La Tourette et al. | 266/243 |
| 3,921,805 A | | 11/1975 | Compere | |
| 3,924,747 A | * | 12/1975 | Gerner | 206/484 |
| 4,506,789 A | | 3/1985 | Dlugosz | |
| 5,244,091 A | | 9/1993 | Tannenbaum | |
| 5,954,202 A | * | 9/1999 | Mellon | 206/462 |
| 6,024,222 A | * | 2/2000 | Friberg et al. | 206/469 |

* cited by examiner

*Primary Examiner*—David T. Fidei
(74) *Attorney, Agent, or Firm*—Arent Fox Kintner Plotkin & Kahn, PLLC

(57) ABSTRACT

A child resistant package having a panel that obstructs removal of the articles being held within the package. When the package is fully opened or fully closed, the panel offers resistance to the removal of the articles contained therein. Only when the panel is in an aligned position do holes in the panel properly align so that the articles within the package can be removed. Each article is sandwiched between a top base portion and a bottom base portion of the package such that the panel can slide in-between the base portions when the package is opened or closed.

13 Claims, 5 Drawing Sheets

CHILD RESISTANT PACKAGE

BACKGROUND

1. Field of the Invention

This invention relates to a child resistant package that offers resistance to removal of articles contained therein when a panel of the package is fully opened or closed and permits removal of the articles only when the panel is properly aligned.

2. Discussion of Related Art

Conventional child resistant packages and dispensers are well known in the art. For an example, U.S. Pat. No. 3,610,410 to Seeley discloses a tamper proof reclosable sliding panel display blister package that has a working panel 25 with a narrow slide panel 31 attached thereto. See FIG. 3. A back panel 23 has a removable portion 32 defined by a perforated line 32*a* to provide a port 34 for discharging articles contained within the blister packaging 19.

As illustrated in FIG. 4, the sliding panel 31 can be withdrawn by bending the extending tab portion 51 rearwardly, which causes the crease 27 to serve as a hinge. The sliding panel 31 thereby moves in and out of the enclosure 44 and is retained under platform 39 and between skirts 41. When the panel 31 is in the fully closed position, as in FIG. 3, the articles contained in the blister packaging are prevented from passing through the port 34. However, when the slide panel 31 is opened or slid in a left to right direction of FIG. 3, the articles within the blister packaging are able to pass through the port 34.

U.S. Pat. No. 2,971,638 to Allison et al. discloses a dispensing container having a pair of front and back sheets 20*a* and 21*a* arranged in facing relation with each other with an inner sheet 22*a* sandwiched there between. The front sheet 20*a* has an elongate opening 24*a* with numerous removable stop elements 25*a* detachably secured within the opening. Outlet openings 27*a* are formed in the back sheet 21*a*.

The inner sheet 22*a* is slidably retained between the outer sheets 20*a* and 21*a*. Formed in the inner sheet 22*a* are a plurality of depressed portions 30*a*, each of which defines a protrusion projecting forward into the front sheet opening 24*a* and a recess opening rearward towards and closed by the back sheet 21*a*. In other words, the recesses 30*a* are all closed by the back sheet 21*a* and the inner sheet 22*a* with the pills 31*a* contained therein being mounted for longitudinal shifting movement therein.

Accordingly, the inner sheet 22*a* is shiftable longitudinally until the recess portions 38 engage an undetached stop element 25*a*. This shifting places the upper most recesses 30*a* in registry with the outlet aperture 27*a* so that the pills may be discharged from the device through the apertures.

U.S. Pat. No. 2,497,455 to Johnson discloses an article dispensing container having side walls 18 and 21, a bottom wall 20, a top wall 22, and inner wall 25. Apertures 28 and 29 are formed in the top wall 22 and inner wall 25, respectively. The container is filled with articles, such as tablets, and the like. In a closed state, the apertures 28 and 29 are offset from each other to prevent the articles from being removed.

In order to dispose the articles, a rear end wall 26, is pivoted inwardly, as shown in FIG. 4, to move the inner wall 25 so as to align the aperture 29 with the aperture 28 of the top wall 22. The container can then be turned upside down to remove the articles.

SUMMARY OF THE INVENTION

An object of this invention is to overcome the above-discussed drawbacks of the conventional child resistant packages and dispensers.

Another object of this invention is to provide a unique package that is child resistant, yet user friendly. The package is structured so that a panel of the package obstructs removal of the articles being held within. In particular, when the package is fully opened or fully closed, the panel offers resistance to the removal of the articles contained therein. Only when the panel is in an aligned position do holes in the panel properly align so that the articles within the package can be removed. Each article is sandwiched between top and bottom base portions of the package such that the panel can slide in-between when the package is opened or closed.

BRIEF DESCRIPTION OF THE DRAWINGS

Other objects and features of this invention will be better understood from the following description, with reference to the accompanying drawings, wherein.

DETAILED DESCRIPTION OF PREFERRED EMBODIMENT

Figure 1:
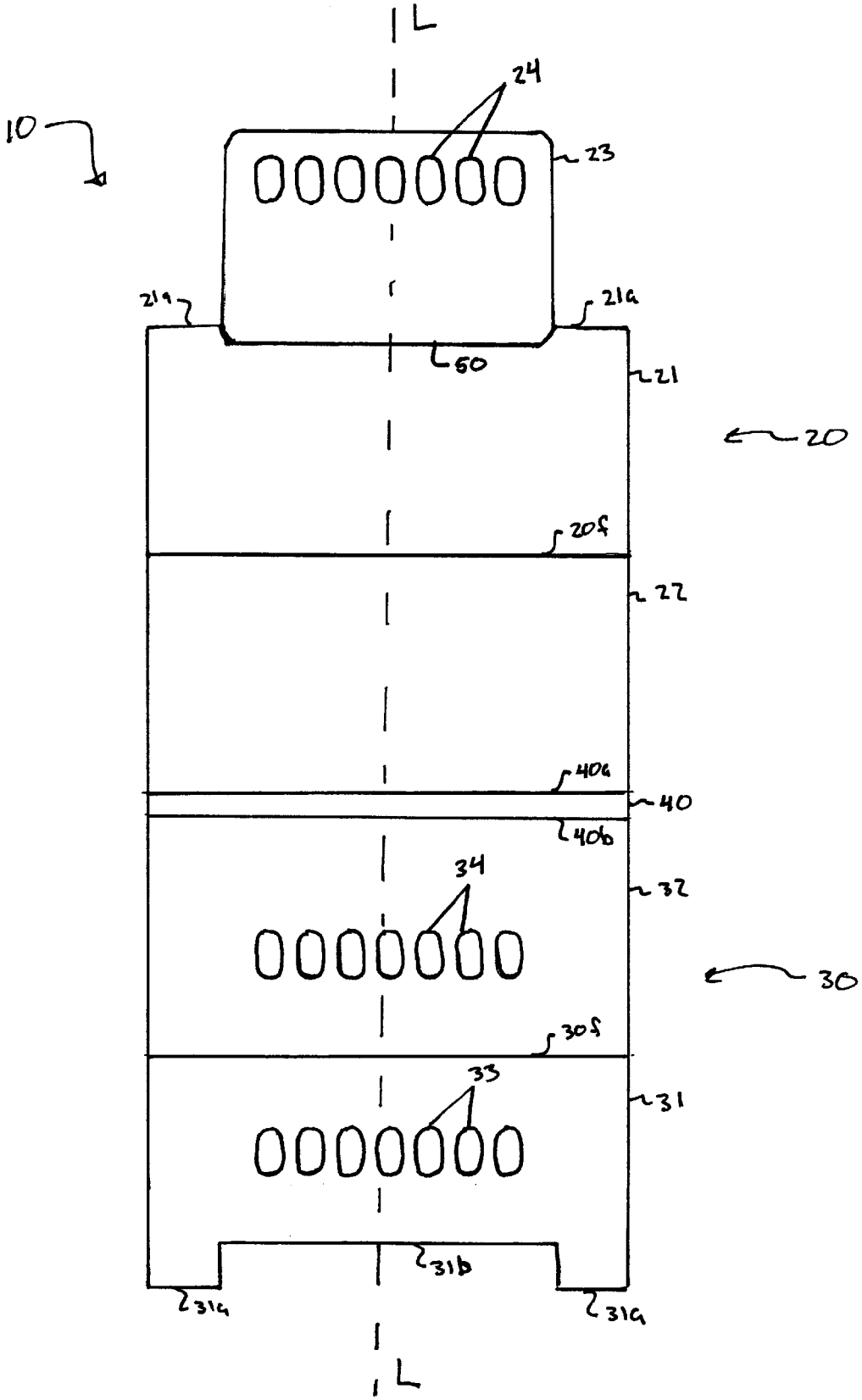
FIG. 1 is a top view of the disassembled package according to the invention.

Referring to FIG. 1, the package 10 is formed from a flat, substantially rectangular shaped single blank 11, ideally made from paperboard. However, it is within the scope of this invention to use any suitable material well known or later developed in the art, such as, for example only, paper, plastic and the like. A hinge 40 is formed by scoring the blank 11 at hinge folds 40*a* and 40*b*, thereby forming a cover 20 and base 30 of the package 10.

The cover 20 is separated into a top cover portion 21 and a bottom cover portion 22 by scoring the cover 20 at cover fold 20*f*. The top cover portion 21 includes a panel 23 that extends away from the hinge 40 when the blank 11 is flat in a direction coaxial with a longitudinal axis L of the blank 11. The panel 23 is foldable at a pivoting hinge 50 to permit the panel 23 to be manipulated between an aligned position and a non-aligned position, as will be described in further detail below. An area of the top cover portion 21 is smaller than an area of the bottom cover portion 22. Thus, the edge 21*a* of the top cover portion 21 does not overlap the hinge fold 40*a* when the top cover portion 21 is folded over the cover fold 20*f*. See FIG. 2.

Also, the panel 23 includes a plurality of alignment holes 24 that are used to obstruct as well as facilitate removal of the articles contained within the package 10 as will be explained in further detail below.

The base 30 is separated into a top base portion 31 and a bottom base portion 32 by scoring the base 30 at base fold 30*f*. The top and bottom base portions 31 and 32, respectively, include a corresponding number of pockets 33 and dispenser elements 34. The pockets 33 typically will contain blister packaging BP that is well known in the art, see FIG. 2A, and is made from such materials as, for example only, a clear plastic, foil, or the like.

The blister packaging BP is used to retain the articles A therein while the dispenser elements 34 may either be formed to have perforations at pf of the bottom base portion 32 or apertures so that the articles A can be pushed from the blister package BP in the pockets 33 and through the alignment holes 24. It is within the scope of this invention to have the dispenser elements 34 comprise a foil backing that is well known in the industry. Then, the articles A are either forced through the dispenser elements 34 by breaking the perforations pf, puncturing the foil backing, or even passing unfettered through the apertures to remove the articles A from the package 10.

An area of the top base portion 31 is smaller than an area of the bottom base portion 32 so that the top base portion 31 can be folded over the base fold 30*f*. Accordingly, the pockets 33 and dispenser elements 34 are aligned with each other and the edge 31*a* of the top base portion 31 does not overlap the hinge fold 40*b*. See FIG. 3.

As shown in FIG. 1, an alignment edge 31*b* of the top base portion 31 is positioned a predetermined distance between the edge 31*a* and the pockets 33.

Figure 2:
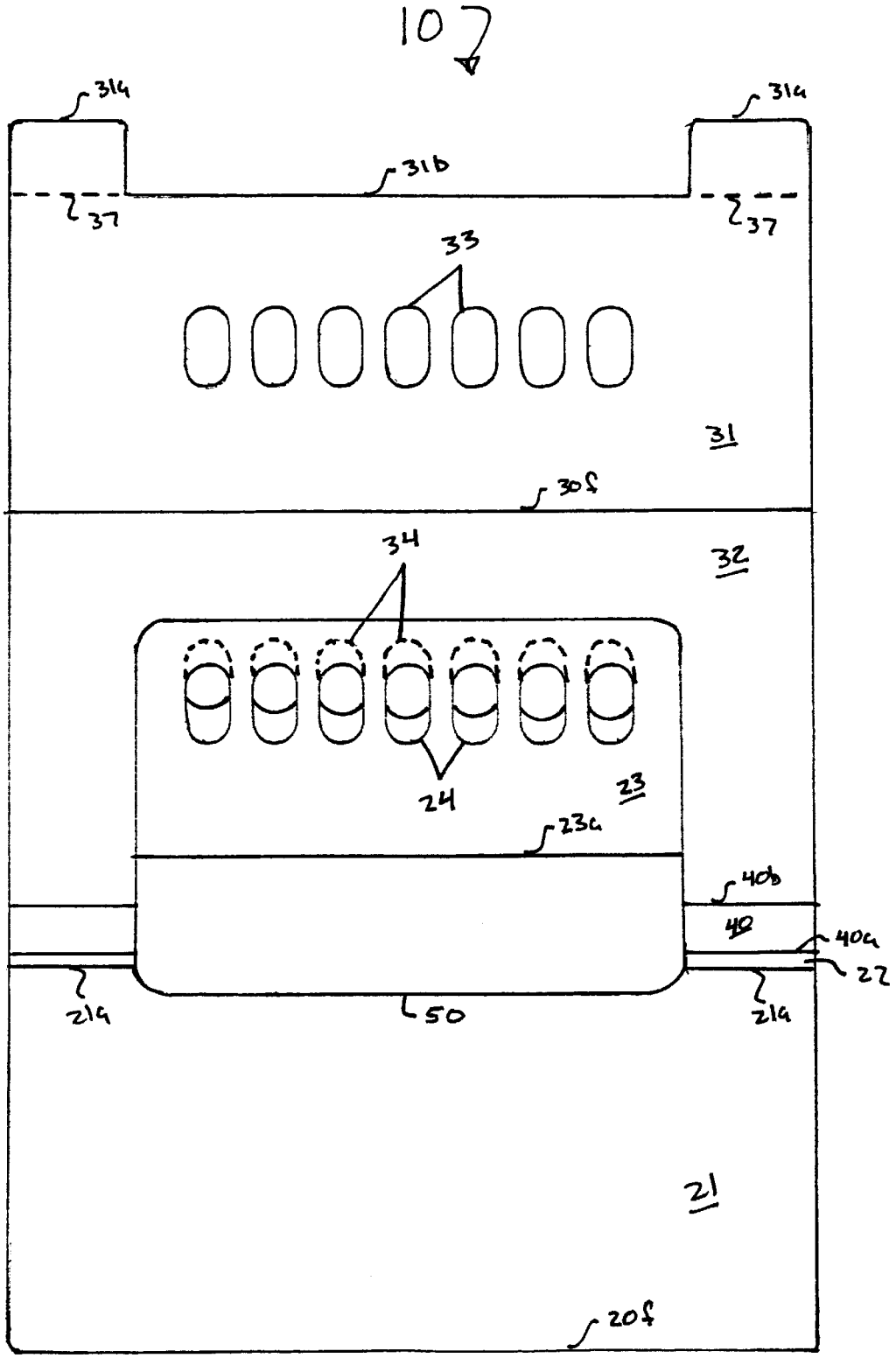
FIG. 2 is a top view of the package of FIG. 1 with the panel and top cover portion folded over the bottom cover portion.
Figure 2A:
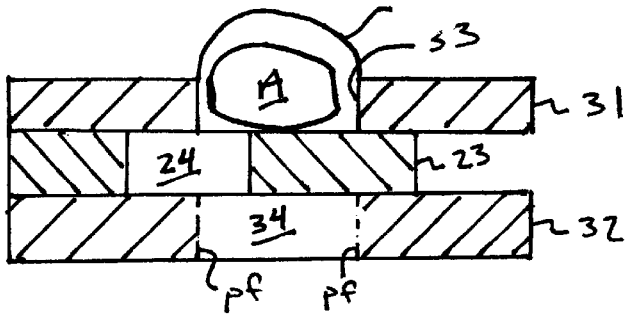
FIG. 2A is a cross-sectional view of the pockets containing blister packaging with the articles maintained therein.

FIG. 2 illustrates a top view of the package 10 with the panel 23 and top cover portion 21 folded over the bottom cover portion 22 along the cover fold 20*f*. As discussed above, the edge 21*a* of the top cover portion 21 does not overlap the hinge fold 40*a*. Furthermore, it is clear that the alignment holes 24 of the panel 23 are offset from the dispenser elements 34 of the bottom base portion 32. Also, an alignment indicator 23*a* of the panel 23 extending from the top cover portion 21 is located intermediate the alignment holes 24 of the panel 23 and the pivoting hinge 50 a predetermined distance.

Figure 3:
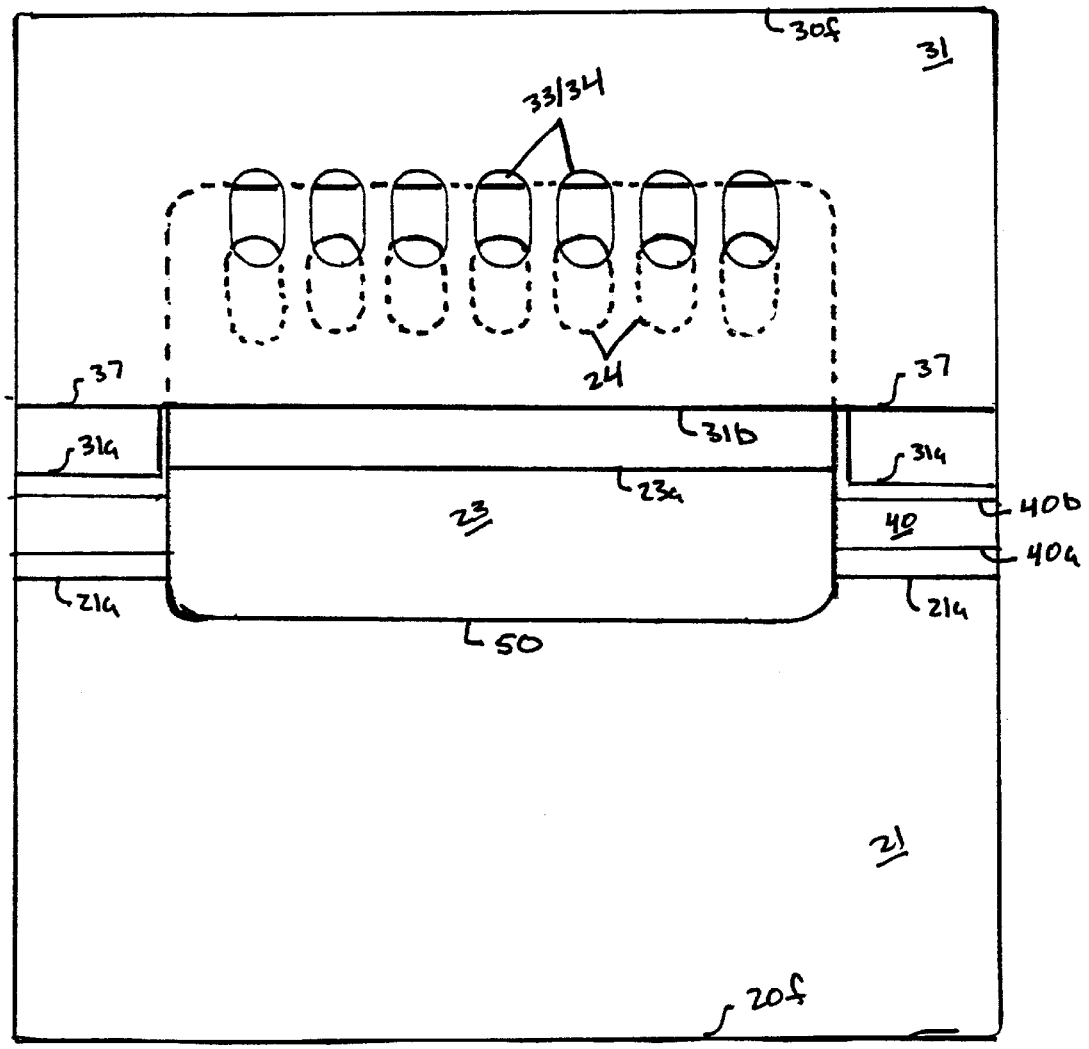
FIG. 3 is a top view of a fully opened package of FIG. 2 with the top base portion folded over the bottom base portion and the panel inserted therebetween.

FIG. 3 illustrates a top view of the package 10 fully opened and the top base portion 31 folded over the bottom base portion 32 with the panel 23 inserted therebetween. As is evident from the drawing figure, the pockets 33 and dispenser elements 34 are aligned with each other. However, the alignment holes 24 of the panel 23 are offset from the pockets 33 and dispenser elements 34.

The offset arrangement of the alignment holes 24 from the pockets 33 and dispenser elements 34, respectively, can be observed by the fact that the alignment indicator 23*a* of the panel 23 is offset from the alignment edge 31*b* of the top base portion 31. Therefore, any articles, such as pharmaceutical products like tablets, pills, etc. and candy, cannot be removed from the blister packaging BP, for example, in the pockets 33 through the alignment holes 24 of the panel 23 and passed through the dispenser elements 34.

Figure 4:
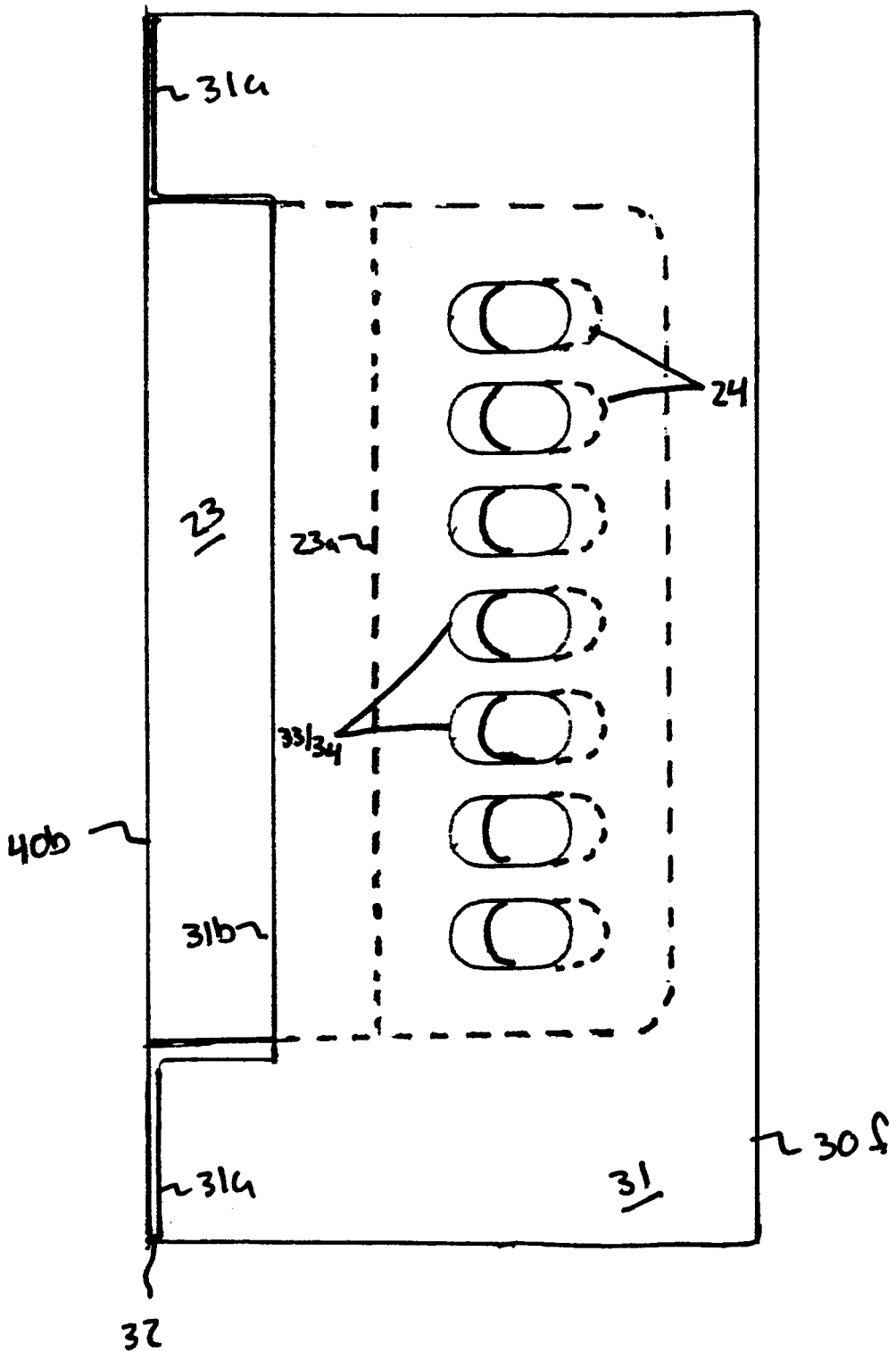
FIG. 4 is a sectional view of a fully closed package of FIG. 3.

FIG. 4 illustrates a sectional view of the package 10 when fully closed. In other words, the cover 20 is not shown. As can be seen, the pockets 33 and dispenser elements 34 are aligned with each other. However, the alignment holes 24 of the panel 23 are offset from the pockets 33 and dispenser elements 34.

The offset arrangement of the alignment holes 24, pockets 33 and dispenser elements 34 can be observed by looking to verify the alignment indicator 23*a* and alignment edge 31*b* are offset, i.e., not aligned. The nonaligned status of the alignment holes 24, pockets 33, and dispenser elements 34, respectively, can also be verified by the fact that the alignment holes 24 of the panel 23 are not aligned with the pockets 33 and dispenser elements 34. Similar to when the package 10 is fully opened, when the package 10 is fully closed, the articles A are prevented from being removed from within the blister packaging BP in the pockets 33 and therefore cannot pass through the alignment holes 24 of the panel 23 and dispenser elements 34.

Figure 5:
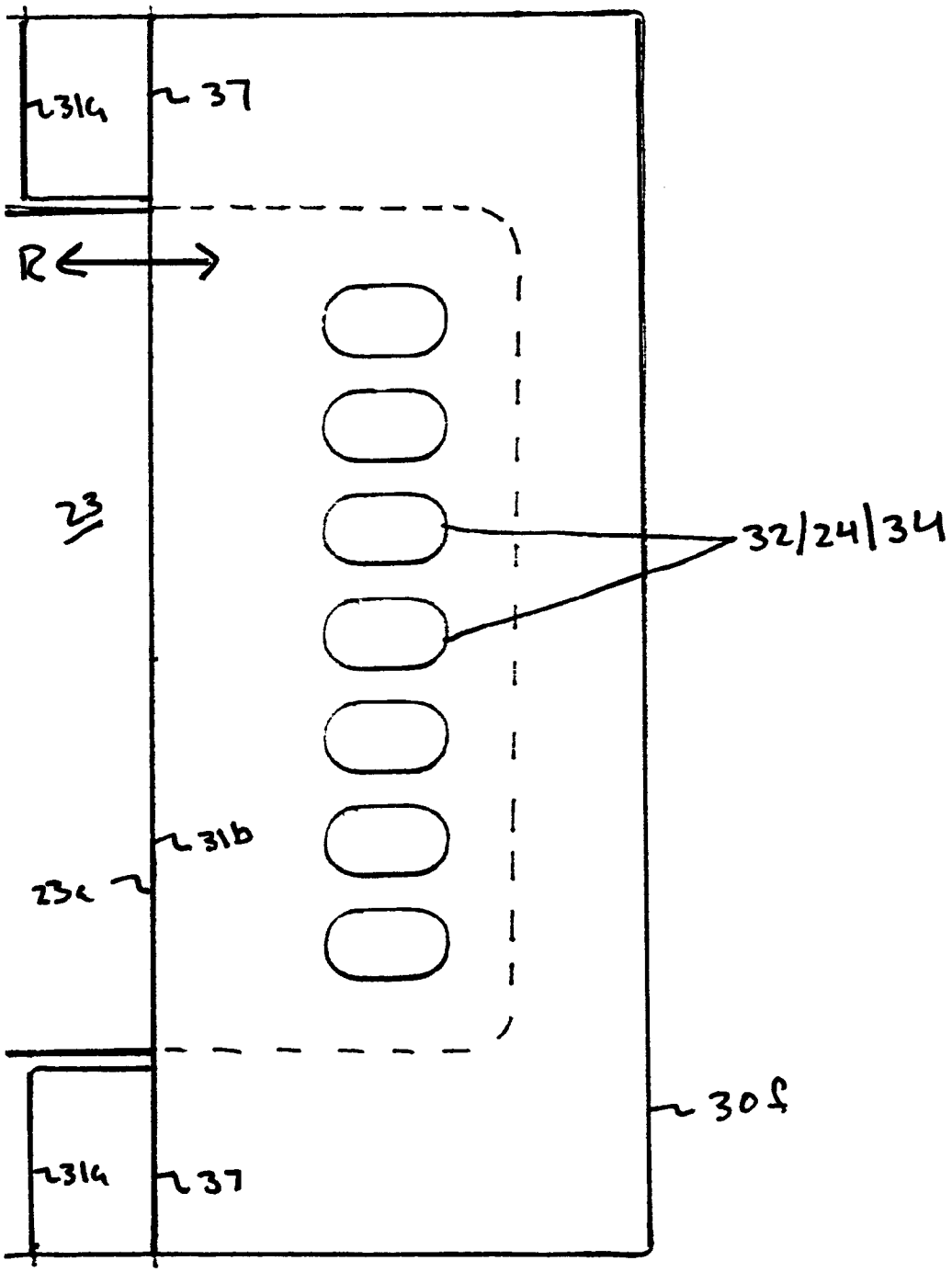
FIG. 5 is a sectional view of the package with the alignment holes of the panel aligned with the pockets and dispenser elements of the base top and bottom portions, respectively.

FIG. 5 is a sectional view of the package 10 with the alignment holes 24 of the panel 23 aligned with the pockets 33 and dispenser elements 34 of the base top and bottom portions 31 and 32, respectively. To accomplish such, the cover 20 is manipulated about the hinge 40 toward the base 30 until the package 10 is nearly in the fully closed state shown in FIG. 3. The cover 20 is then manipulated about the hinge 40 such that the panel 23 slides between the top base portion 31 and bottom base portion 32 in a direction indicated by the arrow R until the alignment indicator 23*a* is aligned with the alignment edge 31*b* of the top base portion 31.

To remove the articles A from the blister packaging BP in the pockets 33, a user must first align the alignment indicator 23*a* on the panel 23 with the alignment edge 31*b* on the top base portion 31 in a manner discussed above. Then, the user pushes downward on the blister packaging BP, forcing the article A contained therein through the pocket 33 and alignment hole 24. The same force then breaks either the perforations pf surrounding the dispenser elements 34 or the foil backing, if present, such that the articles A can pass therethrough. Likewise, if the dispenser elements 34 comprise apertures, the articles A will simple pass therethrough unfettered.

As such, the above-described invention provides a child resistant package using a panel that obstructs articles contained within the package from being removed by children while simultaneously providing a package that is simple to manufacture, easy to use by adults, and cost efficient.

Additionally, many modifications may be made to adapt the teachings of the child resistant package of this invention to particular situations or materials without departing from the scope thereof.

For example, it is optional, as illustrated in FIG. 5, to provide the top base portion 31 with indicator extensions 37 that are placed on the portion 31 beneath the edge 31*a* at a location coaxial to the alignment edge 31*b*. Thus, the alignment indicator 23*a* of the panel 23 may be aligned with the extensions 37 rather than the edge 31*b* to align the alignment holes 24 with the pockets 33 and dispenser elements 34.

Furthermore, it should be noted that the geometric configuration of the package 10 discussed above was described as being rectangular merely for illustrative purposes as well as to simplify the explanation of this invention. It is well within the scope of this invention to provide packages of different geometric shapes, such as, for example only, circular, triangular, elliptical, square, quadrilateral, trapezoidal, and any other well known package shape.

Accordingly, the predetermined distances of the position of the alignment edge 31*a* between the edge 31*a* and pockets 33, and the position of the alignment indicator 23*a* relative to the alignment holes 24 of the panel 23, are to be established based on the geometric configuration of the package as well as the size of the cover 20 and base 30.

Additionally, it is within the scope of this invention to provide more than one row of alignment holes, pockets 33, and dispenser elements 34. A single row of each was discussed above merely to simplify the explanation of this invention.

Therefore, it is contended that this invention not be limited to the particular embodiment disclosed herein, but includes all embodiments within the spirit and scope of the disclosure.

We claim:

1. A child resistant package containing articles, comprising:

blister packaging that retain the articles therein; and a single blank sheet scored at first and second hinge folds to form a hinge positioned between a cover and a base that are separated by and rotatable around the hinge, the base including dispenser elements positioned below pockets that contain the blister packaging, the cover including a panel having alignment holes, wherein the panel is slidable between the pockets and dispenser elements and movable between an offset position that obstructs removal of the articles and an aligned position that arranges the pockets, alignment holes and dispenser elements to permit removal of the articles therethrough.

2. The package according to claim 1, wherein the base is scored at a base fold to form a bottom base portion and a top base portion, the bottom base portion connected to the first hinge fold on one end and the base fold on the other end.

3. The package according to claim 2, wherein the top base portion is connected to the base fold on one end and comprises an alignment edge on the other end, wherein an area of the top base portion is less than an area of the bottom base portion such that an edge on the other end of the top base portion does not overlap the first hinge fold when the top base portion is rotated around the base fold and folded onto the bottom base portion.

4. The package according to claim 3, wherein the top base portion comprises the pockets and the bottom base portion comprises the dispenser elements and the pockets align with the dispenser elements when the top base portion is folded over the bottom base portion.

5. The package according to claim 4, wherein a circumferential edge of the dispenser elements are perforated.

6. The package according to claim 5, wherein the cover is scored at a cover fold to form a bottom cover portion and a top cover portion, the bottom cover portion connected to the second hinge fold on one end and the cover fold on the other end.

7. The package according to claim 6, wherein the top cover portion is connected to the cover fold on one end and the panel on the other end, wherein an area of the top cover portion is less than an area of the bottom cover portion such that an edge on the other end of the top cover portion does not overlap the second hinge fold when the top cover portion is rotated around the cover fold and folded onto the bottom cover portion.

8. The package according to claim 7, wherein the panel comprises an alignment indicator positioned intermediate the alignment holes and edge of the top cover portion.

9. The package according to claim 8, wherein the pockets, alignment holes and dispenser elements are aligned when the alignment indicator of the panel and the alignment edge of the top base portion are aligned.

10. The package according to claim 8, wherein the top base portion further comprises extensions positioned coaxial relative to the alignment edge of the top base portion and the pockets, alignment holes and dispenser elements are aligned when the alignment indicator of the panel and the extensions of the top base portion are aligned.

11. The package according to claim 1, wherein the package comprises a material selected from a group including paperboard, plastic, and paper.

12. The package according to claim 1, wherein the dispenser elements comprise foil.

13. The package according to claim 1, wherein the blister packaging comprises a material selected from a group including plastic, cardboard, and foil.

* * * * *